US005235308A

United States Patent [19]

Shimada et al.

[11] Patent Number: 5,235,308

[45] Date of Patent: Aug. 10, 1993

[54] THERMAL PROTECTOR

[75] Inventors: Toshio Shimada, Tochigi; Morio Kobayashi, Oyama; Takemi Tada; Hirokazu Yokonaga, both of Tochigi, all of Japan

[73] Assignee: Hitachi, Ltd., Tokyo, Japan

[21] Appl. No.: 931,309

[22] Filed: Aug. 18, 1992

[30] Foreign Application Priority Data

Aug. 21, 1991 [JP] Japan ..... 3-209273

[51] Int. Cl.[5] ..... H01H 37/14; H01H 37/54; H01H 61/02

[52] U.S. Cl. ..... 337/377; 337/89; 337/102; 337/380

[58] Field of Search ..... 337/89, 102, 111, 112, 337/131, 133, 334, 365, 372, 373, 380, 377

[56] References Cited

U.S. PATENT DOCUMENTS 4,047,141 9/1977 Holden ..... 337/89
4,885,560 12/1989 Niino et al. ..... 337/89

FOREIGN PATENT DOCUMENTS 174145 11/1988 Japan .

*Primary Examiner*—Harold Broome
*Attorney, Agent, or Firm*—Antonelli, Terry, Stout & Kraus

[57] ABSTRACT

A thermal protector comprises a case having a space surrounded by a bottom surface and a wall surface; a pair of fixed electrodes secured to the bottom surface of the case and located so as to be separated from each other in the space; a disk-shaped bimetal disposed in the space so as to be opposite to the fixed electrodes; a pair of contacts disposed on extremity portions of a surface of the bimetal opposite to the fixed electrodes, the bimetal being either in a conductive state, where the contacts are in contact with the pair of fixed electrodes, or in a non-conductive state, where, the bimetal being deformed, depending on temperature, they are not in contact with the pair of fixed electrodes; and inclined portions disposed on the wall surface with a predetermined interval from the extremity portions of the bimetal when the bimetal is deformed.

20 Claims, 8 Drawing Sheets

THERMAL PROTECTOR

BACKGROUND OF THE INVENTION

The present invention relates to a thermal protector to be mounted in a current circuit between an electric load and a power supply, in which a bimetal connects or disconnects the current circuit, depending on thermal conditions.

In a motor or a product using a motor-compressor such as a refrigerator, an air conditioner, a dehumidifier, etc. generally, a thermal protector is provided in order to prevent burning due to overheating of the motor. A thermal protector is also provided for preventing overheating of a heater, etc. Previously various types of thermal protectors have been proposed. As an example thereof those disclosed in JU-A-59-72641, JU-A-64-35642, etc. will be explained, referring to FIGS. 1 and 2.

The thermal protector of FIGS. 1 and 2 includes a case 1 having an outer bottom surface 1*a*, an inner bottom surface 1*b*, a cover 2, movable contacts 3, 4, a bimetal 5, an adjusting screw 6, a head portion 6*a* on the screw 6, fixed contacts 7, 8, fixed terminals 9, 10, a heater terminal 11, a heater wire 12, and a coil spring 13.

The case 1 is made of a heat-resisting and insulating material such as a synthetic resin, etc., e.g. phenol resin or unsaturated polyester, having a cylindrical form with a bottom. This case 1 is covered with the cover 2 so that an internal space is formed.

In this internal space, the adjusting screw 6, made of brass, is mounted at the center of the bottom, passing therethrough from the inner bottom surface 1*b* to the outer bottom surface 1*a* and the head portion 6*a* is formed at the end of this adjusting screw 6 inside of the case 1. A disk-shaped bimetal 5 is mounted on this adjusting screw 6. Further, the spring 13 is mounted thereon between the bimetal 5 and the inner bottom surface 1*b* of the case 1. The bimetal 5 is pressed against the head portion 6*a* of this adjusting screw 6 by energizing force of this spring 13.

The two movable contacts are secured to the end portions of the bimetal 5 on the surface facing to the inner bottom surface 1*b* of the case 1. Further, the fixed contact 7 at the extremity of the fixed terminal 9 secured to the case 1 so as to pass therethrough from the inner bottom surface 1*b* to the outer bottom surface 1*a* is fixed in opposition to the movable contact 3. In the same way the fixed contact 8, at the extremity of the fixed terminal 10 secured to the case 1 so that a part thereof protrudes outward, is fixed in opposition to the movable contact 4. The heater wire 12 is connected between the heater terminal 11 and the fixed terminal 9 protruding similarly outward by welding, etc. The fixed terminal 10 and the heater terminal 11 serve as external terminals for the thermal protector. This heater wire 12 is disposed so as to be close to the lower surface of the bimetal 5 and to pass the farther side with respect to the adjusting screw 6. The bimetal 5 is heated over the entire periphery by heat produced by the heater wire 12.

The bimetal 5 is shaped in a curved form around the central portion thereof. When the temperature is less than a set value, it is shaped in a curved form, in which the central portion thereof protrudes upward, so that the movable contacts 3 and 4 are in contact with the fixed contacts 7 and 8, respectively. In this way a current path is formed from the fixed terminal 10 to the heater terminal 11 through the fixed contact 8, the movable contact 4, the bimetal 5, the movable contact 3, the fixed contact 7, the fixed terminal 9 and the heater wire 12. When the temperature rises and arrives at the predetermined temperature, the bimetal 5 is rapidly deformed into a curved form, in which the central portion protrudes in a downward direction, contrarily to that indicated in FIG. 1. Hereinbelow this is called inversion movement and the state of the bimetal 5 after the inversion movement is called inverted state. Further the temperature, at which this inversion movement takes place, is called inversion movement temperature. When the bimetal 5 effects the inversion movement, the movable contacts 3 and 4 are separated from the fixed contacts 7 and 8, respectively, so that the current path is in a cut-off state.

When the bimetal 5 is in the inverted state and the temperature is lowered down to the predetermined temperature, the bimetal 5 returns to the state indicated in FIG. 1. Hereinbelow this is called return movement and the state indicated in the figure is called initial state. Further the temperature, at which the return movement takes place, is called return movement temperature. When the bimetal 5 returns from the inverted state to the initial state, the movable contacts 3 and 4 are once again brought into contact with the fixed contacts 7 and 8, respectively, so that the current path is reformed.

In the winding circuit of a motor 15 in FIG. 3, a thermal protector 14' is provided, with the winding circuit including a starting device 16, a starting winding 17, and a main winding 18.

In FIG. 3, only the current path portion described above is indicated for the thermal protector 14' and only the winding portion is indicated for the motor 15. In the motor 15, a series circuit of the starting winding 17 and the starting device 16 is connected with the main winding 18 in parallel. The motor 15 and the thermal protector 14' are connected in series by connecting one of the terminals of the motor 15 with the heater terminal 11. In this manner, current flows from the power supply 20 to the starting winding 17 of the motor 15 and the main winding 18 through the fixed terminal 10, the bimetal 5, the heater wire 12 and the heater terminal 11.

When mechanical lock of the motor is produced during drive of the motor due to burning of bearing portions of the motor 15 or the compressor driven by the motor 15 or penetration of dust into rotating parts, a high intensity current corresponding to the starting current continues to flow therethrough, because the rotor does not rotate. This high intensity current continues to flow, as far as the rotor is locked in the state where the power supply is connected therewith. This current is called lock current. The lock current is about four to five times as high as the nominal current of the motor 15. The duration of the starting current (starting period) at normal start is usually as short as two to three seconds and the motor is so designed to bear satisfactorily such a high intensity starting current flowing in this short period of time. However, in the design, it is not taken into account that the lock current continues to flow for a long period of time through the motor 15 and the current circuit therefor, which is not desirable.

When a large current flows through the motor 15, heat generation by the bimetal 5 and the heater wire 12 increases. At the moment where the temperature of the bimetal 5 arrives at the inversion movement temperature, the bimetal rapidly effect the inversion movement. Thus, the movable contacts 3 and 4 are separated from the fixed contacts 7 and 8 so that feed of current to the motor 15 is stopped. After the feed of current to the motor 15 has been stopped, the bimetal 5 and the heater wire 12 begin to be cooled. When the temperature is lowered down to the return movement temperature of the bimetal 5, the bimetal 5 rapidly effects the return movement to return to its initial state. Thus, the movable contacts 3 and 4 are brought into contact with the fixed contacts 7 and 8, respectively, so that the feed of current to the motor 15 is again started.

At this time, if the locked state of the motor 15 is removed, the bimetal 5 does not effect again the inversion movement and thus the motor 15 is driven normally.

Next another example of a prior art thermal protector of the type described, for example, in JU-A-60-183349 will be explained, referring to FIG. 4.

This prior art example differs basically from the prior art example indicated in FIG. 1 in that no heater wire is provided. For this reason, the fixed terminal 9 having the fixed contact 7 at the extremity passe through the bottom portion of the case 1 so as to protrude outward and constitutes external terminals together with the fixed terminal 10. When the movable contacts 3 and 4 contact the fixed contacts 7 and 8, respectively, a current path is formed from the fixed terminal 10 to the fixed terminal 9 through the fixed contact 8, the movable contact 4, the bimetal 5, the movable contact 3 and the fixed contact 7.

When such a thermal protector 14" is used for the motor 15, one of the fixed terminals 9 of the thermal protector 14" is connected with one of the terminals of the motor 15 (FIG. 5).

When some abnormalities are produced in the motor 15 and a high intensity lock current flows therethrough, heat generation by the bimetal 5 increases. At the moment where the temperature is raised up to the inversion movement temperature of the bimetal 5, the bimetal rapidly effects the inversion movement, the movable contacts 3 and 4 are separated from the fixed contacts 7 and 8, respectively, and feed of current to the motor 15 is stopped. When the feed of current is stopped, the bimetal 5 begins to be cooled. When the temperature is lowered to the return movement temperature of the bimetal 5, the bimetal 5 rapidly effects the return movement to return to its initial state. Thus the movable contacts 3 and 4 are brought into contact with the fixed contacts 7 and 8, respectively, and the feed of current to the motor 15 is restarted started again.

At this time, if the locked state of the motor 15 is removed, the bimetal 5 does not effect return movement anymore and the motor 15 is driven normally.

As described above, according to each of the prior art examples described above, if the locked state is removed during the inverted state of the bimetal 5, the motor 15 returns to the normal drive state and thus burning due to overheating can be prevented.

However, if the abnormal state of the motor 15 is not removed, the bimetal 5 effects the return movement to return to its initial state. But, if the motor 5 is again in the locked state, a high intensity lock current flows through the thermal protector 14" and the bimetal 5 again effects the return movement. Thus, the bimetal 5 is in the locked state and the feed of current to the motor 15 is stopped.

As described above, if the abnormal state of the motor 15 is not removed, the bimetal 5 repeats the inversion movement and the return movement and after a number of these repetitions, the bimetal 5 is finally fatigued and broken.

In JU-A-60-183349 cited previously, as shown in FIG. 6 a bimetal 5 is used, in which stress dispersing slits 5c are disposed radially around a shaft supporting hole 5b, in which the adjusting screw is inserted. If such a bimetal 5 repeats the inversion movement and the return movement, breaks extending from extremities of the slits 5c towards the outer periphery 5d, as indicated by E and F, are produced. As the result of the breaks, the radius of the bimetal 5 is increased by internal stress in the bimetal 5 and the outer peripheral portions 5d in the neighborhood of the contacts are deformed from those indicated by chain-dotted line to those indicated by full lines, as indicated in FIG. 6.

If the bimetal 5 is broken, characteristics of the bimetal 5 are changed. Thus, the inversion movement temperature and the return movement temperature are changed or even if it effects the inversion movement, the amount of the inversion movement is decreased. In this way the interval between inversion movements is shortened and the rate of the lock current flowing through the bimetal 5 and the heater wire 12 increases. Therefore, the temperature within the case rises more and more. Further, this is accompanied by decrease in the contact pressure of the movable contacts 3 and 4. If the lock current continues to flow, the movable contacts 3 and 4 are finally bonded by fusion with the fixed contacts 7 and 8, respectively. When bonding by fusion of the contacts is produced as described above, the high intensity lock current flows without interruption through the winding of the motor 15 and the bimetal 5 in the thermal protector 14' or 14" and the winding of the motor 15 generates heat, which gives rise to burning. Further, the temperature within the case 1 is raised by heat produced by the bimetal 5 and the heat wire 12 and when the temperature exceeds the tolerable highest temperature of the case 1 and the cover 2, the case 1 and the cover 2 are burned in the neighborhood of the bimetal 5.

In the prior art example indicated in FIG. 1, if the heater wire 12 is broken when the temperature within the case 1 is increased, the current path in the thermal protector 14' is cut and therefore the burning described above can be prevented. Thus, there is no danger. However, the heater wire 12 is not always broken. Further in the thermal protector having no heater wire indicated in FIG. 4 even this operation cannot be expected.

Heretofore various means have been proposed for solving such problems as described above.

As one of them, e.g. in JU-A-59-72641, a thermal protector using heat resisting materials such as ceramics for the case is disclosed.

Furthermore, e.g. in JU-A-63-174145, means is disclosed, in which there is disposed a movement counting plate having a plurality of sawtooth-shaped protrusions, which are engaged one after another with the bimetal every time it effects a return movement, to lower the movement counting plate. When the bimetal effects the return movement a number of times, which is equal to the number of the sawtooth-shaped protrusions, the movement counting plate is brought into contact with the inner bottom surface of the case so that the bimetal cannot effect the return movement anymore. According thereto, even if the abnormal state of the motor is not removed, if the bimetal has effected the return movement a predetermined number of times, it cannot effect the return movement anymore. Therefore, the inverted state is held and the lock current is cut off.

Still further, in, for example, JU-A-63-224125, means is disclosed, in which there is disposed a second bimetal having an inversion movement temperature higher than that of a first bimetal connected in series with the second bimetal, the inversion movement of the first bimetal is produced by generation of abnormal current, the abnormal state being not removed, the first bimetal repeats the inversion movement and the return movement, and when the first bimetal is finally destroyed and the contacts are bonded by fusion, the inversion movement of the second bimetal is produced by abnormal rise of the temperature taking place as the result, which cuts off the abnormal current.

Still further, in JU-A-64-1450 or JP-A-1-82424, a technique is disclosed, by which a second bimetal is brought into contact with the lower surface of a first bimetal and when the first bimetal is broken and contacts are bonded by fusion, the second bimetal effects the inversion movement to raise the first bimetal.

Still further, in JU-A-64-35642 or JP-A-1-279532 and JP-A-1-44232, a technique is disclosed, by which the head portion of the shaft, on which the bimetal is mounted, is a part separated from the shaft, a recess is formed in this head portion, and this recess is filled with thermally fusible metal, when this head portion is engaged with the shaft, so that the head portion is secured to the extremity of the shaft by this thermally fusible metal. Normally, the bimetal is pressed against the head portion by a spring, but when the contacts of the bimetal are bonded by fusion and the temperature is raised, the thermally fusible metal is melted so that the sticking between the head portion and the shaft is removed and the bimetal and the head portion are raised by energizing force of the spring.

Still further, in, for example, JU-A-2-128338, a technique is disclosed, by which an engaging metal piece is engaged with the shaft, which serves as a shaft supporting portion, and when the temperature rises, the engaging metal piece is deformed so that the engagement with the shaft is removed and the bimetal is raised by energizing force of the spring.

Furthermore, in, for example, JU-A-2-128339, a technique is disclosed, by which there is disposed a receiving metal piece o the upper surface of the bimetal to constitute a bimetal shaft supporting portion, which piece is deformed at a high temperature so as to have a small height, and the bimetal is raised by energizing force of the spring.

Although various sorts of countermeasures against bonding by fusion of the contacts of the bimetal have been proposed as described above, these have different problems as follows.

That is, when made of ceramics as described in JU-A-59-72641, there is a problem that, although burning of the case is certainly avoided, burning of the motor coil cannot be avoided and the case is expensive.

Further, the technique, by which the movement counting plate is disposed as disclosed in JU-A-63-174145, had problems as follows, because the number of repetitions of the inversion movement and the return movement is limited by this movement counting plate;

(1) For the thermal protector used in a refrigerator, an air conditioner, a dehumidifier, etc., it took place easily that the bimetal is moved even by a defect of a compressor motor or a fan apart from mechanical lock of the motor and that the bimetal is held by the movement counting plate in the inverted state, which increases the number of service calls.

(2) Such problems at realizing it in practice remain that the movement counting plate is displaced also at confirming the operation during adjusting work and that the remaining number of movements decreases.

Further, in the case where a first and a second bimetal, connected in series, were used as described in JU-A-63-224125, since it was necessary to make a current flow therethrough simultaneously, problems at realizing it in practice remained as follows:

(1) The region of the intensity of current, which can be made flow therethrough, is limited, depending on specific resistance of these bimetals.

(2) When the specific resistance of the bimetals is insufficient so that the amount of heat generated by themselves is too small, it is necessary to provide a heater wire. Since it is necessary, therefore, to secure a sufficient insulating distance between the bimetals and the heater wire, the space occupied by the heater wire is great and the size of the thermal protector increases.

(3) It is necessary to dispose expensive contacts on each of the first and the second bimetal and therefore the thermal protector itself is expensive.

Still further, in the case where the head portion is stuck to the shaft with the thermally fusible metal as described in JU-A-64-35642 or JP-A-1-279532 and JU-A-2-44232, the thermal protector has the following problems:

(1) When the contacts of the bimetal are bonded by fusion, the thermally fusible metal begins to melt and the bimetal and the head portion of the shaft are raised by the spring. However, they are only slowly raised by the spring only slowly because of viscosity of the thermally fusible metal. When the movable contacts are separated from the fixed contacts disposed on the inner bottom surface of the case due to the raising of the bimetal the current path is cut. Therefore, the feed of current to the heater is stopped and, at the same time, the heat source is lost. Thus, the state of the thermally fusible metal moves towards solid phase.

As described above, when there is no sufficient spring force for satisfactorily overcoming the viscosity of the thermally fusible metal acting thereon, no satisfactory contact separation distance (contact gap) between the movable contact and the fixed contact is secured, when the bimetal is raised.

(2) The solidification phenomenon of the thermally fusible metal described above is load resistance itself of the spring and acts so as to reduce the force for separating the contacts of the spring from each other when they are bonded by fusion. It can be presumed that this can be hindrance to obtaining a thermal protector for turning a load on and off at a high intensity current.

(3) Since there is creep in the bond by the thermally fusible metal, the melting point thereof should have a sufficiently great temperature difference with respect to the inversion movement temperature. For this reason, working temperature for performing a contact separating operation is high and utilization field of the thermal protector is apt to be limited.

(4) Equipment having a high stability is required for penetration of the thermally fusible metal into the recess formed in the head portion of the shaft and cost of equipment is therefore high.

Still further, in the case where an engaging metal piece is used at the bimetal shaft supporting portion as described in JU-A-2-128338, following problems arise:

(1) It is necessary to form a ring-shaped groove on the shaft, which causes cost-up by increase in the number of fabrication steps.

(2) Since a shape memory alloy is used for the engaging metal piece, the deformation speed is low. Therefore, it requires a long time, before it is separated from the ring-shaped groove.

(3) Since an expensive material is used for the engaging metal piece, the thermal protector itself is expensive.

Still further, in the case where a receiving metal piece is used on the upper surface of the bimetal as described in JU-A-2-128339, there are the following problems:

(1) When the threaded portion of the shaft is rotated to adjust the inversion movement temperature to a predetermined set temperature and at the same time to obtain a contact pressure between the movable contact and the fixed pressure, the shaft supporting position for the bimetal is moved and at the same time bending magnitude of the receiving metal piece is varied. Accompanied by these variations, working temperature of the receiving metal piece is varied also.

(2) Further the shaft supporting position for the bimetal at the predetermined set temperature is determined at a position where the resultant force of the resilient force of the bimetal and the energizing force of the spring and the force of the receiving metal piece are balanced. The point where the two forces are balanced varies without interruption and, therefore, it is difficult to adjust it.

(3) In the state where the bimetal has effected the inversion movement and the movable contacts are separated from the fixed contacts, the shaft supporting position for the bimetal is determined at a position where the downward force of the receiving metal piece and the upward energizing force of the receiving metal piece are balanced.

That is, since there is no resilient force of the bimetal, the spring is varied in the compression direction by the energizing force of the receiving metal force and acts in the direction where the contact separation distance (contact gap) decreases. In the worst case, no satisfactory contact separation distance can be obtained and it is feared that it looses the function as the thermal protector.

(4) In any case, it is difficult to fabricate the thermal protector, unless size precision, etc. of different constituent parts are remarkably increased.

What can be said in common for all the prior art examples is as follows.

(1) The object can be achieved by adding some constituent parts thereto.

(2) The fabrication steps are complicated and new equipments should be added to a conventional equipment. At the same time the prime cost is remarkably increased by lowering in the fabrication yield at the adjustment, etc.

SUMMARY OF THE INVENTION

The object of the present invention is to provide an inexpensive thermal protector having a simple construction and capable of solving the problems of the prior art techniques described above, which can surely cut off the current circuit, before the contacts are bonded by fusion, when the bimetal is broken.

The thermal protector according to the present invention comprises a case having a space surrounded by a bottom surface and a wall surface: a pair of fixed electrodes secured to the bottom surface of the case and located so as to be separated from each other in the space: a disk-shaped bimetal disposed in the space so as to be opposite to the fixed electrodes; and a pair of contacts disposed at the extremities of the surface of the bimetal opposite to the fixed electrodes; wherein the bimetal is either in a conductive state, where the contacts contact the pair of fixed electrodes, or in a non-conductive state, where, the bimetal being deformed, depending on the temperature, the contacts do not contact the pair of fixed electrodes, and wherein the case has inclined portions disposed on the wall surface with a predetermined interval from trajectories of an extremity portions of the bimetal, when it is deformed.

The operation of the thermal protector according to the present invention is as follows.

(1) The contact between the movable contacts and the fixed contacts is interrupted due to fact that the extremities of the peripheral portion of the bimetal are contacted with the inclined portion of the case with a bottom and further action thereof is restricted.

(2) The contact between the movable contacts and the fixed contacts is interrupted due to the fact that the extremities of the peripheral portion of the bimetal are contacted with a stepwise portion of the case with a bottom and further action thereof is restricted.

(3) The operation of the bimetal can be secured by the action described above, because the broken part of the bimetal can be controlled at an arbitrary position.

As the result, the feed of current to the motor winding is interrupted and it is possible to prevent not only burning of the motor winding but also burning of the thermal protector.

DESCRIPTION OF THE PREFERRED EMBODIMENTS

Figure 1:
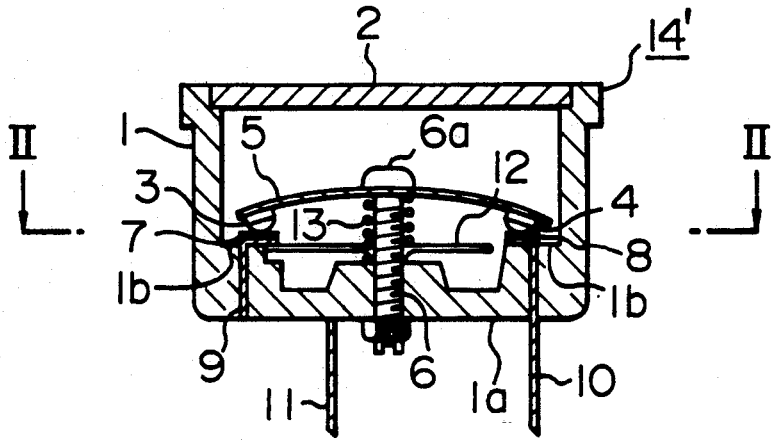
FIG. 1 PRIOR ART
FIG. 1 is a longitudinal cross-sectional view of a prior art thermal protector.
Figure 2:
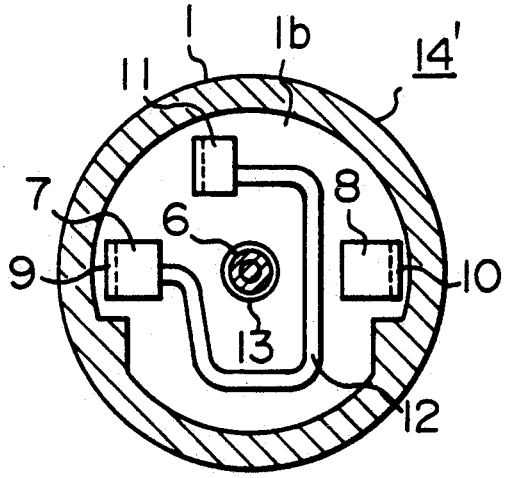
FIG. 2 PRIOR ART
FIG. 2 is a cross-sectional view taken along a line II—II' in FIG. 1.

The identical parts corresponding to those indicated in FIG. 1 are represented by the same reference numerals and duplicated explanation therefor will be omitted.

Figure 7:
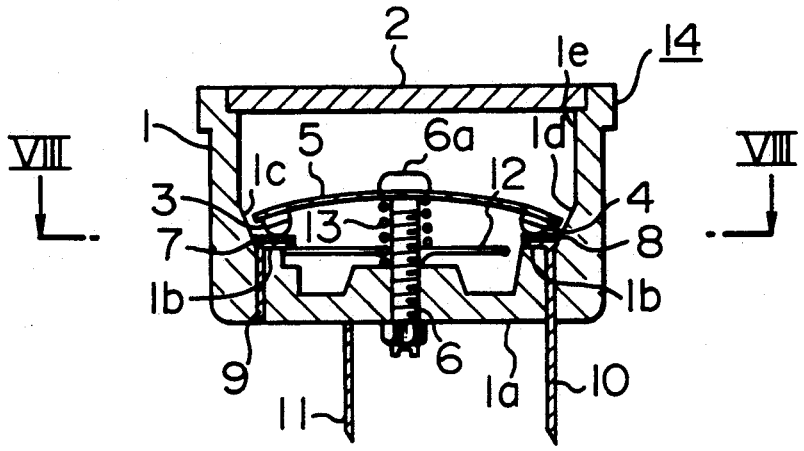
FIG. 7 is a longitudinal cross-sectional view of a thermal protector according to the present invention.

Referring now to FIG. 7, a case 1 is provided including a pair of inclined portions disposed on the wall surface of the case 1 in the neighborhood of the bimetal 5, to which the movable contacts 3 and 4 are secured.

Figure 3:
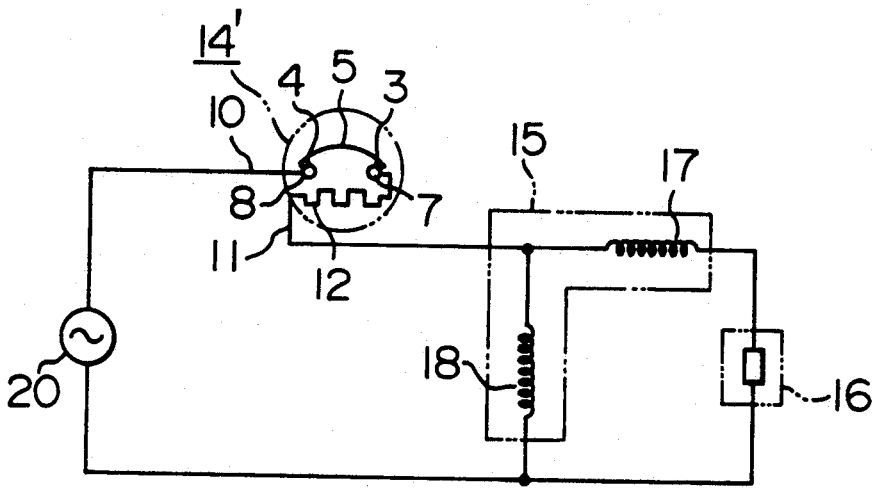
FIG. 3 PRIOR ART
FIG. 3 is a circuit diagram incorporating the thermal protector of FIG. 1 in a circuit for a motor.
Figure 4:
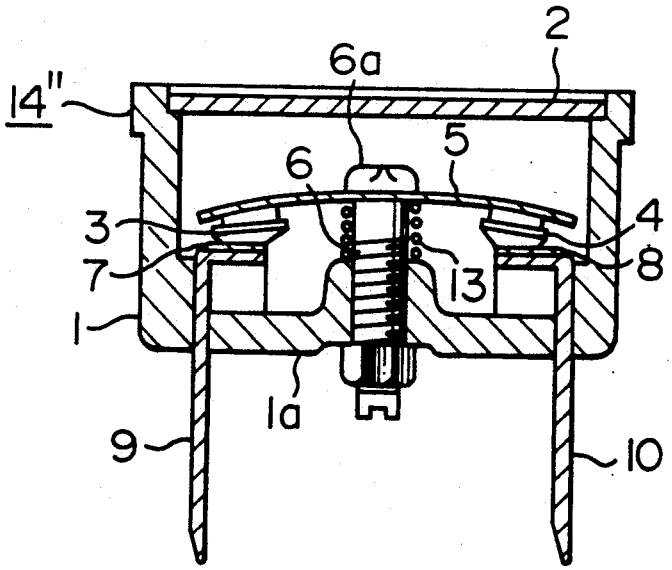
FIG. 4 PRIOR ART
FIG. 4 is a longitudinal cross-sectional view of another prior art thermal protector.
Figure 5:
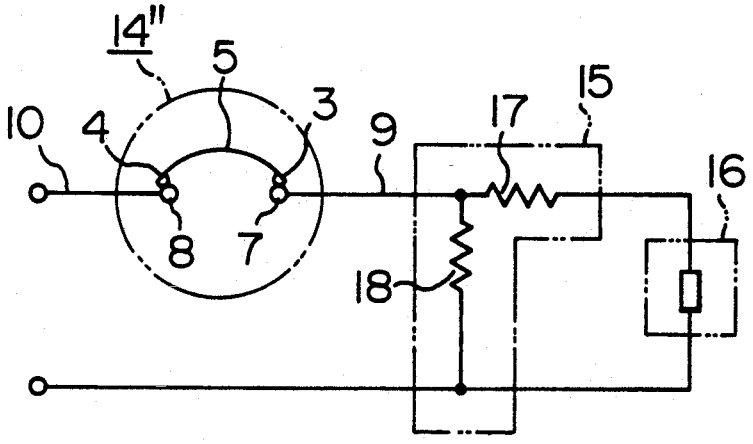
FIG. 5 PRIOR ART
FIG. 5 is a circuit diagram, incorporating the thermal protector of FIG. 4 applied to a circuit for a motor.

When the thermal protector 14 is used in the circuit indicated in FIG. 3, in the state where the motor 15 is rotated normally, after a starting current having a high intensity has flowed for a short time through the bimetal 5 and the heater wire 12, a low intensity drive current is continuously supplied thereto. Usually, the duration, where the starting current flows, is shorter than about two seconds and limited by the operation of the starting device 16, etc.

Similarly to the prior art techniques, at this time, the bimetal 5 does not effect the inversion movement at the temperature rise due to heat generating energy in the bimetal 5 itself and heating energy in the heater wire 12.

If an excessive lock current as high as the starting current at maximum flows continuously through the motor 15, self heat generating energy in the bimetal 5 and the heater wire 12 increases. At the moment where the temperature rises up to the working temperature of the bimetal 5, the bimetal 5 itself rapidly effects the inversion movement and the movable contacts 3 and 4 are separated from the fixed contacts 7 and 8 so that the feed of current to the motor 15 is interrupted.

After the feed of current has been interrupted, the bimetal 5 and the heater 12 begin to be cooled. At the moment where the temperature is lowered to the return movement temperature, the bimetal 5 effects an inversion movement, which is opposite to the movement described previously, to return to its initial position. In this manner, the movable contacts 3 and 4 are brought to the fixed contacts 7 and 8 so that the feed of current to the motor 15 is again started.

Similarly to the prior art techniques, after the reestablishment stated above, if the locked state of the motor 15 is removed, the motor 15 is normally driven and the inversion movement of the bimetal 5 doesn't take place anymore.

Figure 6:
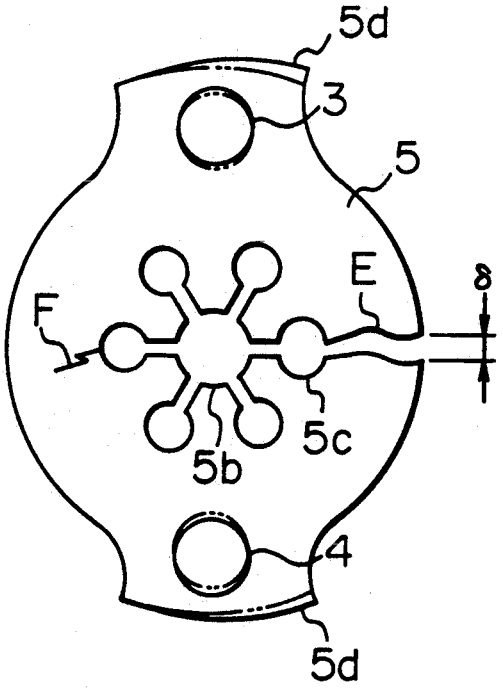
FIG. 6 PRIOR ART
FIG. 6 is a plan view of broken bimetal.

It is supposed that the locked state continues and that while the bimetal 5 repeats the inversion movement and the return movement, the bimetal is fatigued and breaks extending from extremities of slits 5c to the outer peripheral portion 5d as indicated by E and F in FIG. 6 are produced.

The bimetal 5 has such internal stress that the bimetal 5 has a tendency to return from the curved shape indicated in FIG. 7 to a flat shape. The bimetal 5 has a satisfactory strength for holding its shape against the internal stress having the tendency to return the bimetal itself to its initial shape by forming plate-shaped bimetal material into the curved shape a press.

In the case of a complete break as indicated by E, the bimetal 5, formed forcedly in a curved shape by press, has a tendency to return to its initial shape and the diameter thereof increases. Thus, the break E gives rise to a gap having an interval δ. In the case of the break E, the interval δ is about 0.1 to 0.3 mm.

At the moment when the interval δ is produced, the outer size of the bimetal 5 increases by an amount corresponding to the interval δ in the direction perpendicular to the break line after the break, in this case, in the direction towards the outer peripheral portions 5d indicated by full lines, i.e. in the direction connecting the movable contacts 3 and 4. In FIG. 6 the shape before the break is indicated by chain-dotted lines.

Figure 9:
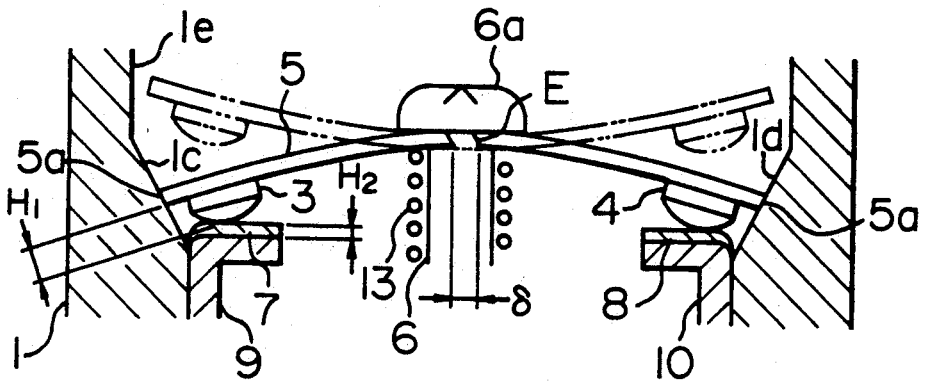
FIG. 9 is a cross-sectional view, on an enlarged scale, for explaining the operation at the inversion of the bimetal of the thermal protector according to the present invention.

Now it is supposed that the bimetal 5 is at a position indicated by a full line in FIG. 9 at the moment where it is going to effect the inversion movement. Both the intervals between the extremities of the bimetal 5 and the inclined portions 1c and 1d are set at about 0.1 to 0.3 mm. At the normal drive the extremities of the bimetal 5 are not contacted with the inclined portions 1c and 1d. When the break E is produced in the bimetal 5 at the position indicated by a full line in FIG. 9, the diameter of the bimetal 5 is increased by a gap δ and the extremities thereof are brought into contact with the inclined portions 1c and 1d. However, the bimetal 5 has a tendency to be deformed into a shape indicated by a chain-dotted line in FIG. 9 by the internal stress having a tendency to restore its initial flat shape and the inverting force due to cooling. The bimetal 5 is so designed that this deforming force is greater than frictional force between the extremity portions thereof and the inclined portions 1c and 1d. Therefore, the bimetal 5 is deformed from the position indicated by the full line into that indicated by the chain-dotted line in FIG. 9, overcoming the frictional resistance between the inclined portions 1c and 1d of the case and them. Thereafter, the bimetal 5 is cooled and returns to its initial position. At this time, the extremity portions 5a of the outer peripheral portions 5d in the neighborhood of the movable contacts 3 and 4 of the bimetal 5 are brought into contact with the inclined portions 1c and 1d at the position, as indicated by the full line in FIG. 10, so that further movement thereof is restricted.

By this restriction, the contact between the movable contacts 3, 4 and the fixed contacts 7, 8 is prevented. Here the chain-dotted line shows the normal working position of the bimetal 5 before the break.

Figure 10:
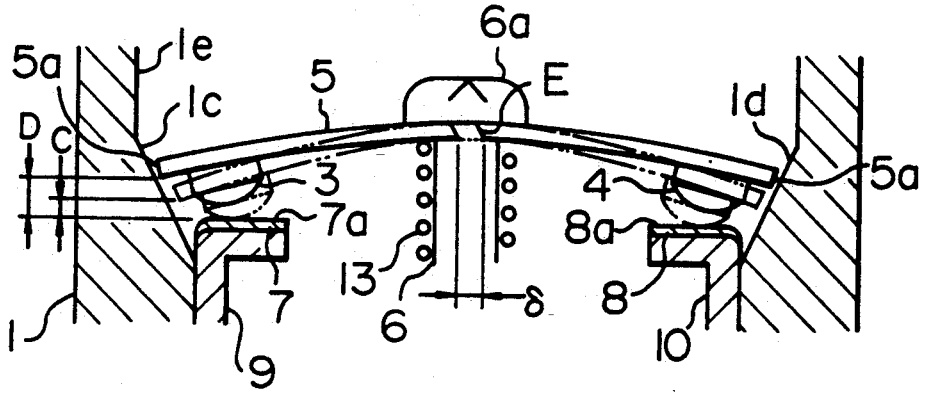
FIG. 10 is a cross-sectional view, on an enlarged scale, for explaining the operation at the return of the bimetal of the thermal protector according to the present invention.

Further, if the break is produced at the returning inversion, the bimetal 5 returns to the state at the position indicated by the full line in FIG. 10, similarly to the return from the working inversion. The extremity portions 5a of the bimetal 5 are caught by the inclined portions 1c and 1d, before the movable contacts 3 and 4 are brought into contact with the fixed contacts 7 and 8 and thus the contact between the movable contacts 3, 4 and the fixed contacts 7, 8 is prevented.

In general, the working and returning inversion movement is repeated usually more than 10,000 times, before the bimetal 5 is broken. It is well-known that when load current is turned on and off this number of times, the movable contacts 3, 4 and the fixed contacts 7, 8 are consumed by arc, etc. at turning on and off the load and that the heights H1 and H2 thereof decrease.

Since the operation described previously and indicated in FIG. 10 is effected in such a state, the apparent contact positions between the extremities 5a of the bimetal 5 and the inclined portion 1c and 1d of the case 1 are varied from a size C indicated by a chain-dotted line, which is a reference for the initial position, to another size D indicated by a full line, which is a reference for the working point of time, referring to the contact surfaces 7*a* and 8*a* of the fixed contacts 7 and 8. For this reason, a satisfactory contact separating distance between the movable contacts 3, 4 and the fixed contacts 7, 8 can be secured at the break of the bimetal 5.

Further, since the operation for removing the bonding by fusion after the generation thereof and attention to the bonding force of the contacts, which were necessary in the prior art examples, are no more required by the present invention, it is possible to reduce the volume of the movable contacts 3, 4 and the fixed contacts 7, 8. As the result it is possible to arbitrarily control variations in the heights H1 and H2 and thus to obtain a more perfect contact open mode.

As described above, since the operation end mode of the thermal protector according to the present invention is a contact open mode, the current path for the motor is not re-fed with current and, therefore, it is possible to prevent not only burning of the motor 15 but also burning of the thermal protector itself.

Further, since the bimetal is moved by detecting the starting point of time of the break, the degree of thermal influences on the load (degree of burning) is extremely small with respect to that suffered by the prior art techniques, by which the bimetal is moved by detecting the temperature rise after the bonding by fusion of the contacts. It has been experimentally verified that no differences are found from the normal operation of the bimetal 5.

Furthermore, according to the present invention, since the contact open mode can be established at a point of time before the generation of the bonding by fusion of the contacts, there is no restriction in the application to a high intensity current load region, where the binding force by fusion increases as by prior art means techniques, and, in addition, the thermal protector according to the present invention is useful also for loads, which are burned even in the contact open mode, depending on the loads.

Consequently, an effect can be obtained that can be applied to all sorts of loads, i.e. not only to any loads from a low intensity current region to a high intensity current region but also to any loads having a rapid temperature rise, etc., regardless of the sort thereof.

In addition, since the principal part of the means therefor ,is simply formed in one body with the case, it can be easily supplied at a low cost. That is, it has an advantage that it can be realized only by changing the shape of the case, modifying a die therefor.

Further, it is not necessary to introduce new equipment and therefore a great practical effect can be obtained.

Although, in the present embodiment, a thermal protector having a heater wire 12 has been explained, it is a matter of course that the same effect can be obtained, regardless of presence or absence of the heater wire 12.

Further, although explanation has been made, supposing that the load is a motor 15, even if there are no variations in the current as in a heater load, in the case where the ambient temperature, in which the thermal protector is located, rises by some reason, since it can work only by variations in the ambient temperature, the field of utilization is not at all restricted.

Figure 8:
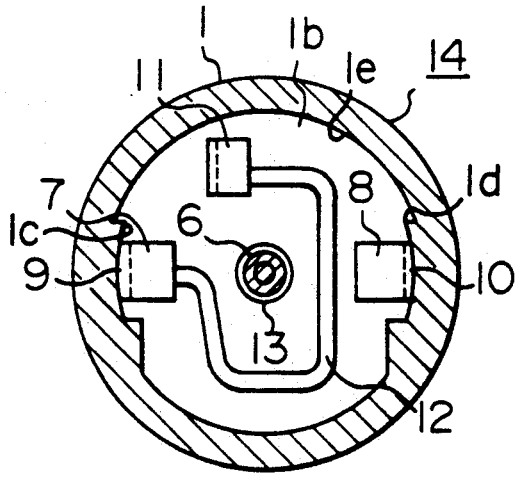
FIG. 8 is a cross-sectional view taken along a line VIII—VIII in FIG. 8.
Figure 11:
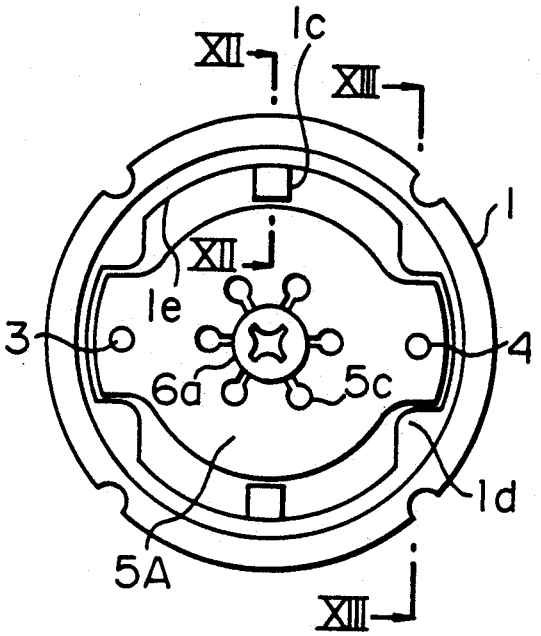
FIG. 11 is a plan view, when the cover of the thermal protector according to the present invention is removed.
Figure 12:
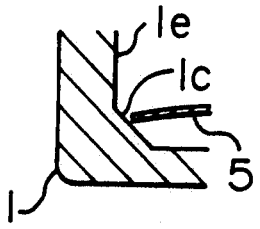
FIG. 12 is a cross-sectional view of same along a line XII—XII in FIG. 11.
Figure 13:
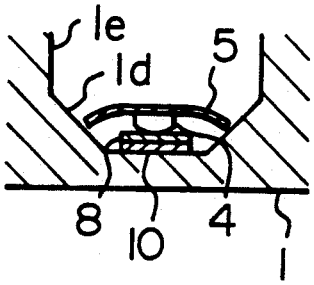
FIG. 13 is a cross-section view of same along a line XIII—XIII in FIG. 11.
Figure 14:
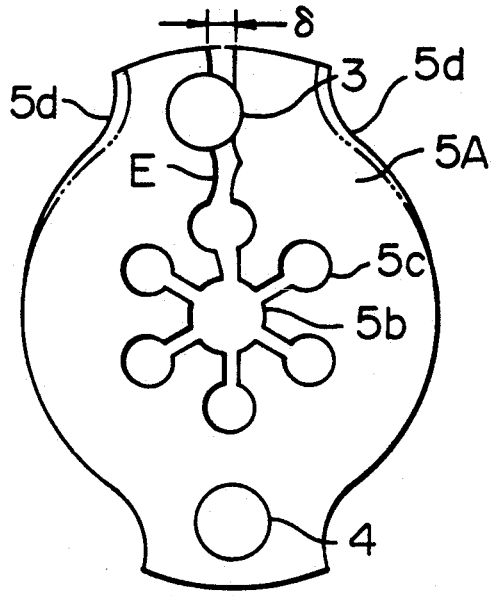
FIG. 14 is a plan view of the bimetal of FIG. 11 in broken condition.

The embodiment of FIGS. 11, 12 and 13 differs from the embodiment of FIGS. 7 and 8 in that there are disposed a plurality of inclined portions 1*c* and 1*d* on the wall surface 1*e* of the case 1 at arbitrary positions near to the outer peripheral portions of the bimetal 5A so as to be symmetrical with respect to the center of the bimetal 5 in order that the effect can be exhibited, even if the break of the bimetal 5A does not increase the outer size thereof in the direction connecting the movable contacts 3 and 4, as indicated by a full line in FIG. 14. In FIG. 14, the shape before the break is indicated by chain-dotted lines.

Figure 15:
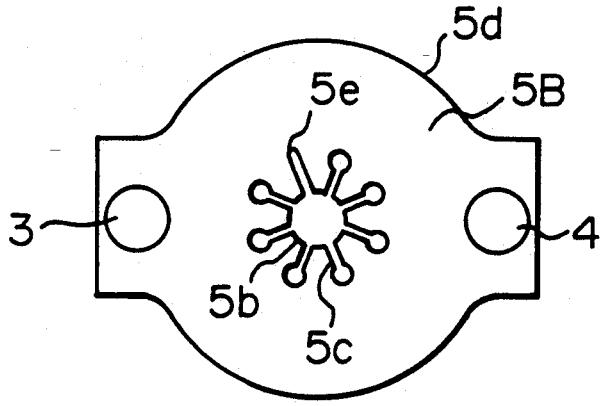
FIG. 15 is a plan view of a bimetal used in the thermal protector according to the present invention.

The embodiment of FIG. 15 represents means for controlling the position of the break in the bimetal 5B so that the effect is ensured, when it is combined with a thermal protector. That is, at least one slit 5*e* of a plurality of stress dispersing slits 5*c* disposed radially from the shaft supporting hole 5*b* of the bimetal 5B towards the outer peripheral portion has a shape different from the other slits 5*c* so as to form the most stressed portion.

Since the break begins at the most stressed portion, it is possible to form the gap $\delta$ at the position where the gap $\delta$ of the broken place is greatest or at an action position, where the outer size increases in the direction towards the inclined portions described previously.

Figure 16:
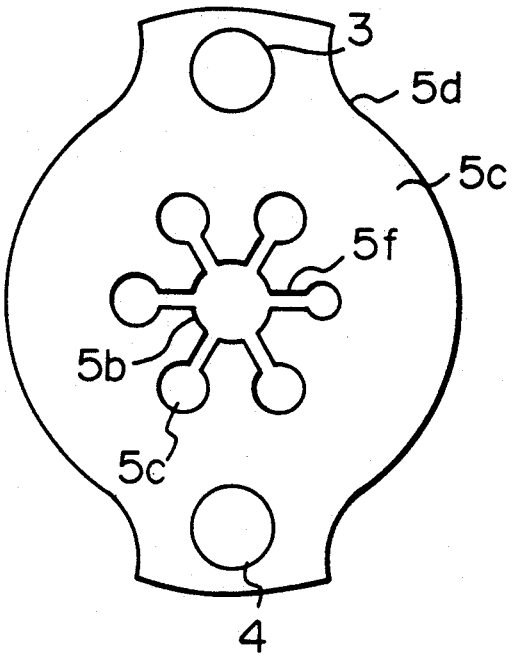
FIG. 16 is a plan view of another bimetal used in the thermal protector according to the present invention.

The embodiment of FIG. 16 represents means for controlling the position of the break in the bimetal 5C so that the effect is ensured, when it is combined with a thermal protector, similarly to the embodiment indicated in FIG. 15. That is, at least one slit 5*f* of a plurality of stress dispersing slits 5*c* disposed radially from the shaft supporting hole 5*b* of the bimetal 5C towards the outer peripheral portion has a shape different from the other slits 5*c*.

According to the embodiment indicated in FIG. 16 it is possible to obtain the same effect as that obtained in the embodiment indicated in FIG. 15.

Figure 17:
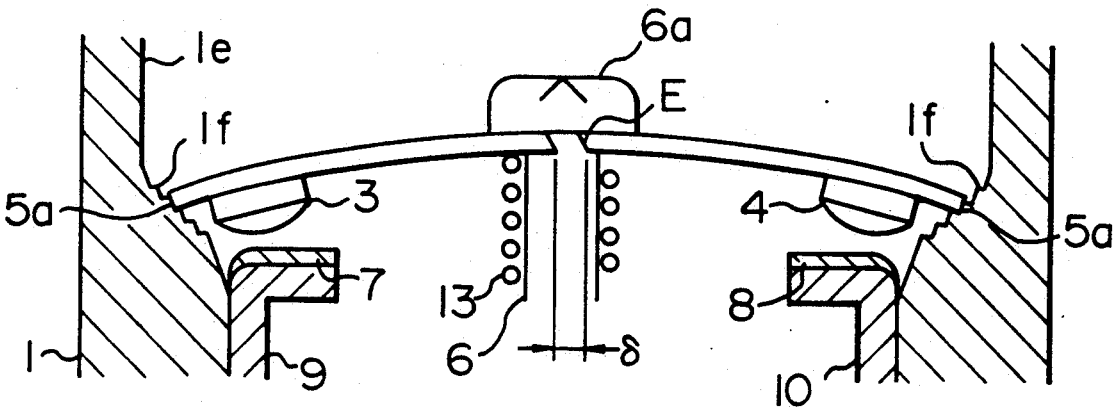
FIG. 17 is a longitudinal cross-sectional view, on an enlarged scale of the bimetal port of a thermal protector according to the present invention.

In the embodiment of FIG. 17 there are disposed stepwise portions 1*f* having the same effect as the inclined portions 1*c* and 1*d* described previously on the wall surface 1*e* of the case 1 and FIG. 17 shows a working state where the end surfaces 5*a* of the outer peripheral portions 5*d* of the bimetal 5 are in contact with these stepwise portions 1*f*.

Concerning the position, the number, etc., the stepwise portions 1*f* may be disposed similarly to the preceding embodiments, where there are disposed the inclined portions. By disposing the stepwise portions 1*f* it is possible to restrict more efficiently the movement of the bimetal 5.

In the embodiments of the present invention explained above, the surfaces of the inclined portions 1*c* and 1*d* are formed approximately along the working envelopes of the extremity portions of the bimetal 5 with a predetermined distance measured from the extremity portions. Consequently, the shape of the longitudinal cross-section thereof is rectangular or stepwise. The cross-sectional shape of the inclined portion in the thermal protector according to the present invention is not limited thereto, but it may be a curved shape. Although the inclined portions in the embodiments described above are formed together with the case, when it is formed by a die, the inclined portions may be formed separately from the case and thereafter they may be installed in the case. The present invention is not limited to the disclosed embodiments, but various improvements and modifications may be added thereto, based on the content of the disclosure As explained above in detail, according to the present invention, excellent effects as described below can be obtained.

(1) When the bimetal is fatigued and broken, the current path is permanently cut off and thus it is possible to prevent simultaneously not only burning of the load of the thermal protector but also burning of the thermal protector.

(2) When abnormalities are produced in the load of the current path before the bimetal is fatigued and broken, the bimetal repeats necessarily the inversion movement and the return movement. When the abnormalities are removed, the bimetal necessarily closes the current circuit so that the load is in a state where it is usable. As soon as the bimetal is broken, a satisfactory contact separating distance is secured. In this way, reliability can be remarkably improved.

(3) Regardless of presence or absence of the heater wire, the operation for protecting the load is effected precisely and surely.

(4) Without adding any bimetal, shape memory alloy member, etc. to the prior art techniques it can be formed in a small size and weight and the object can be achieved by using only conventional constituent parts. Consequently, without sacrificing any characteristics of the original thermal protector, an inexpensive thermal protector can be obtained.

(5) A high reliability can be obtained for loads in a wide region from a low intensity current to a high intensity current and thus the field of utilization is remarkably extended.

That is, according to the present invention, it is possible to obtain an inexpensive thermal protector having the simplest construction capable of cutting off permanently the circuit before the bonding by fusion just after the break of the bimetal.

What is claimed is:

1. A thermal protector comprising:

a case having a space surrounded by a bottom surface and a wall surface;

a pair of fixed electrodes secured to the bottom surface of said case and located so as to be separated from each other in said space;

a disk-shaped bimetal disposed in said space so as to be opposite to said fixed electrode;

a pair of contacts on extremity portions of a surface of said bimetal opposite to said fixed electrodes, said bimetal being either in a conductive state, wherein said contacts are in contact with said pair of fixed electrodes, or in a non-conductive state, where said bimetal being deformed, depending on temperature, said pair of contacts are not in contact with said pair of fixed electrodes; and inclined portions disposed on said wall surface with a predetermined spacing from said extremity portions of said bimetal when the bimetal is deformed, said predetermined spacing is so set that the extremity portions of said bimetal are brought into contact with said inclined portions when a crack is produced in said bimetal and a diameter of said bimetal is increased.

2. A thermal protector according to claim 1, wherein said case is a substantially cylindrical case made of non-conductive material and said inclined portions are protrusions protruding from said wall surface of said cylindrical case towards a center of said case, which protrusions are so formed that protruding amount increases with decreasing distance from the bottom surface.

3. A thermal protector according to claim 2, wherein each of said protrusions has a substantially rectangular cross-sectional shape, viewed along said wall surface, the part closest to said bottom surface being a base.

4. A thermal protector according to claim 2, wherein each of said protrusions has a stepwise cross-sectional shape, viewed along said wall surface, extending farther from said wall surface with decreasing distance from the bottom surface.

5. A thermal protector according to claim 3, further comprising a shaft holding a central portion of said disk-shaped bimetal, wherein said bimetal has a plurality of slits extending radially from the central portion held by said shaft to an outer peripheral portion and at least one of said plurality of slits has a shape so selected that it is subjected to a greater stress than the others at said deformation.

6. A thermal protector according to claim 4, further comprising a shaft holding a central portion of said disk-shaped bimetal, wherein said bimetal has a plurality of slits extending radially from the central portion held by said shaft to an outer peripheral portion and at least one of said plurality of slits has a shape so selected that it is subjected to a greater stress than the others at said deformation.

7. A thermal protector according to claim 5, wherein said at least one subjected to a greater stress than the other slits has a smaller area than the others.

8. A thermal protector according to claim 6, wherein said at least one subjected to a greater stress than the other slits has a smaller area than the others.

9. A thermal protector according to claim 3, wherein there is disposed at least one of said inclined portions on said wall surface in the neighborhood of said contacts of said bimetal.

10. A thermal protector according to claim 4, wherein there is disposed at least one of said inclined portions on said wall surface in the neighborhood of said contacts of said bimetal.

11. A thermal protector according to claim 3, wherein said plurality of inclined portions are disposed on said wall surface symmetrically with respect to the central portion of said bimetal.

12. A thermal protector according to claim 4, wherein said plurality of inclined portions are disposed on said wall surface symmetrically with respect to the central portion of said bimetal.

13. A thermal protector according to claim 9, wherein said plurality of inclined portions are disposed on said wall surface symmetrically with respect to the central portion of said bimetal.

14. A thermal protector according to claim 10, wherein said plurality of inclined portions are disposed on said wall surface symmetrically with respect to the central portion of said bimetal.

15. A thermal protector according to claim 5, wherein said inclined portions are disposed on said wall surface at positions in a direction perpendicular to the length direction of the slit subjected to a greater stress than the others.

16. A thermal protector according to claim 6, w said inclined portions are disposed on said wall surface at positions in a direction perpendicular to the length direction of the slit subjected to a greater stress than the others.

17. A thermal protector according to claim 1, wherein resilient force for deforming said bimetal so that said contacts are separated from said fixed electrodes is given to said bimetal and it comprises a shaft for holding a central portion of said disk-shaped bimetal; a spring member disposed around said shaft in contact which the central portion of said bimetal, which gives said bimetal a force in a direction where said contacts are pressed to said fixed electrodes against said resilient force, and an adjusting member for adjusting said pressing force of said spring member, wherein said resilient force of said bimetal when cracks are produced in said bimetal is set so as to be greater than frictional force between the extremity portions of said bimetal and said inclined portions.

18. A thermal protector according to claim 17, wherein said predetermined interval is set at such a value that the extremity portions of said bimetal are brought into contact with said inclined portions, when a diameter of said bimetal is increased by generation of cracks in said bimetal, so that movement of the contacts of said bimetal to close to said fixed electrodes is prevented.

19. A thermal protector according to claim 1, further comprising an electric heater connected in series with said pair of fixed electrodes and generating heat owing to current flowing therethrough so as to heat said bimetal.

20. A thermal protector mounted in a current circuit for a motor, the thermal protector comprising:

a case having a space surrounded by a bottom surface and a wall surface;

a pair of fixed electrodes secured to the bottom surface of said case and located so as to be separated from each other in said space, said pair of fixed electrodes being connected in series with the circuit, through which winding current for the motor flows;

a disk-shaped bimetal disposed in said space so as to be opposite to said fixed electrodes;

a pair of contacts disposed on extremity portions of a surface of said bimetal opposite to said fixed electrodes, said bimetal being either in a conductive state where said contacts are in contact with said pair of fixed electrodes, or in a non-conductive state, where, said bimetal being deformed, depending on temperature, said pair of contacts are not in contact with said pair of fixed electrodes; and inclined portions disposed on said wall surface with a predetermined interval from said extremity portions of said bimetal when said bimetal is deformed, said predetermined interval is so set that the extremity portions of said bimetal are brought into contact with said inclined portions when a crack is produced in said bimetal and a diameter of said bimetal is increased.

* * * * *